US005871790A

United States Patent [19]

Monier et al.

[11] Patent Number: 5,871,790

[45] Date of Patent: Feb. 16, 1999

[54] LAMINATED BAG WALL CONSTRUCTION

[75] Inventors: James L. Monier, Sibley, Iowa; Dennis A. Olsheski, Moore, S.C.

[73] Assignee: Union Camp Corporation, Lawrenceville, N.J.

[21] Appl. No.: 810,043

[22] Filed: Mar. 4, 1997

[51] Int. Cl.[6] ..... A21D 10/02; H05B 6/80; B65D 30/08

[52] U.S. Cl. ..... 426/107; 426/118; 426/124; 426/127; 383/116; 428/211; 219/730

[58] Field of Search ..... 426/107, 118, 426/124, 127; 383/116; 428/211; 219/730

[56] References Cited

U.S. PATENT DOCUMENTS

| | | | |
|---|---|---|---|
| 559,138 | 4/1896 | Lorenz et al. . | |
| 1,752,370 | 4/1930 | Cornell . | |
| 1,953,686 | 4/1934 | Natwick | 206/16 |
| 2,854,186 | 9/1958 | Williams | 229/55 |
| 3,023,947 | 3/1962 | McDuffie | 229/55 |
| 3,098,563 | 7/1963 | Skees | 206/46 |
| 3,305,160 | 2/1967 | Lehman | 229/55 |
| 3,549,381 | 12/1970 | Kinsinger | 99/77.1 |
| 4,068,425 | 1/1978 | Brandberg et al. | 426/107 |
| 4,069,964 | 1/1978 | Willet et al. | 229/62.5 |
| 4,190,757 | 2/1980 | Turpin et al. | 210/10.55 |
| 4,196,331 | 4/1980 | Leveckis et al. | 219/10.55 |
| 4,219,573 | 8/1980 | Borek | 426/107 |
| 4,725,465 | 2/1988 | Lastovich | 428/35 |
| 4,727,706 | 3/1988 | Beer | 53/434 |
| 4,797,010 | 1/1989 | Coelho | 383/109 |
| 4,835,037 | 5/1989 | Beer | 428/35.2 |
| 4,943,456 | 7/1990 | Pollart et al. | 428/34.3 |
| 5,081,330 | 1/1992 | Brandberg et al. | 219/10.55 |
| 5,097,956 | 3/1992 | Davis | 206/524.8 |
| 5,124,519 | 6/1992 | Roy et al. | 219/10.55 |
| 5,134,001 | 7/1992 | Osgood | 428/35.2 |
| 5,171,594 | 12/1992 | Babbitt | 426/107 |
| 5,177,332 | 1/1993 | Fong | 219/10.55 E |
| 5,317,118 | 5/1994 | Brandberg et al. | 219/727 |
| 5,326,576 | 7/1994 | Zuege | 426/107 |
| 5,338,921 | 8/1994 | Maheux et al. | 219/730 |
| 5,399,022 | 3/1995 | Sheets | 383/103 |
| 5,428,209 | 6/1995 | Babu et al. | 219/730 |
| 5,460,839 | 10/1995 | Archibald | 426/107 |
| 5,489,766 | 2/1996 | Walters et al. | 219/730 |
| 5,553,942 | 9/1996 | Domke et al. | 383/101 |
| 5,650,084 | 7/1997 | Bley | 219/727 |
| 5,690,853 | 11/1997 | Jackson et al. | 219/727 |
| 5,753,895 | 5/1998 | Olsen et al. | 219/727 |

*Primary Examiner*—Nina Bhat
*Attorney, Agent, or Firm*—Dennis H. Lambert

[57] ABSTRACT

A multi-ply laminated wall structure, especially for a bag for popping popcorn in a microwave oven, has at least two plies of paper secured together with spaced patches of adhesive to form a unitary laminated structure that has greater flexibility and lower cost than a conventional bag wall. The adhesive covers from about 25% up to about 60% of the confronting area between the plies, and the unsecured areas between the patches of adhesive are in communication with one another. The outer ply is gas permeable so that gas is permitted to escape from between the plies, and any moisture between the plies escapes through the unsecured areas between the patches of adhesive at the ends of the laminated structure.

26 Claims, 4 Drawing Sheets

LAMINATED BAG WALL CONSTRUCTION

BACKGROUND OF THE INVENTION

1. Field of the Invention

This invention relates in general to multi-wall bag constructions. More particularly, the invention relates to the adhesive lamination of multiple plies of sheet material to form a multi-wall structure which may be folded to define a bag, and which, in a preferred embodiment, defines a bag for receiving, storing and popping a quantity of popcorn kernels in a microwave oven.

2. Background of the Invention

There are many known containers for storing and cooking food, including microwavable bags for popping popcorn. Such bags are typically formed of multiple plies of paper adhesively laminated together to form a multi-wall construction, and have a microwave susceptor in one panel for absorbing microwave energy and heating the contents of the bag. In conventional constructions, the entire confronting area between the plies is coated with adhesive, whereby the adhesive forms an essentially continuous layer between the plies of paper. This construction uses a large amount of adhesive and results in a relatively stiff wall, which degrades the performance of the bag and increases its cost. For instance, the expanded shape of the bag is affected by the stiffness of the wall, and may not be aesthetically pleasing or optimal for full cooking of the food contained in the bag.

Some prior art bags have been constructed with the plies or laminations forming the wall of the bag secured together with spaced, discrete areas or patches of adhesive, rather than coating the entire confronting surface between the plies with adhesive. However, the utilization of spaced patches of adhesive in these prior art constructions is for the purpose of producing an insulating wall structure, or forming an expandable shape that causes the inflating bag to move or shift its position in the heating chamber as the bag expands during cooking, or to enable one ply to move relative to the other. Examples of such prior art constructions are shown U.S. Pat. Nos. 1,953,686, 3,098,563, 5,081,330 and 5,317,118.

U.S. Pat. No. 1,953,686 to Natwick describes a bag for use in forming bricks of carbon black, and secures the plies "a" and "b" of the bag wall together with spaced patches of adhesive "c", so that the plies can shift relative to one another during compression of the bag and its contents. The spots of adhesive are intended merely to tack the plies together, rather than to form a unitary laminated wall structure, and cover probably less than ten percent of the confronting area between the plies. The wall of this bag thus comprises two separate walls that are merely held in juxtaposition to one another by the spots of adhesive, rather than to form a unitary laminated structure.

U.S. Pat. No. 3,098,563 to Skees describes an inflatable heat insulating structure in which an expandable fluid is placed between the plies of the wall, and the inner and outer plies are sealed together around their periphery to prevent escape of the fluid, and at spaced points across their area to prevent excessive bulging or rounding of the structure as the fluid between the plies expands to expand the plies apart in their unsecured areas to form expanded insulation chambers.

U.S. Pat. Nos. 5,081,330 and 5,317,118 both describe structures in which adhesive is applied between the plies in spaced patches to define a plurality of discrete sealed chambers or pockets which expand when the bag is heated to define insulation chambers.

None of the prior art suggests a bag whose wall is formed of multiple plies secured together by spaced patches of adhesive to form a unitary laminated wall structure which uses less adhesive and which has greater flexibility than conventional bag wall structures, and which, due to its greater flexibility, has at least equal or improved performance and aesthetics as compared with conventional bags.

Consequently, a need exists for an inexpensive and effective way of constructing a multi-wall bag formed of multiple plies of paper secured together by spaced patches of adhesive to define a unitary structure which requires less adhesive than conventional bags, thereby costing less, and which also has greater flexibility for improved performance and aesthetics.

SUMMARY OF THE INVENTION

In accordance with the present invention, the plies forming the bag wall are secured together with spaced patches of adhesive to define a multi-wall structure that is more flexible and less expensive to make than prior art bags, and yet which has at least equal or even enhanced performance and improved aesthetics as compared with conventional bags.

More specifically, the bag of the invention comprises two plies of paper laminated together to form a multi-wall bag structure. Although as described herein, the invention is specifically applied to a bag for popping popcorn in a microwave oven, the invention also has utility in other multi-wall constructions intended for other uses.

The bag of the invention, when used as a container for popping popcorn in a microwave oven, has front and back panels joined by gusseted side panels. The front panel of the bag contains a microwave susceptor and is normally positioned downwardly or lower than the other side when placed in a microwave oven to pop the kernels of corn held therein. A bottom end of the bag is closed and sealed with a suitable adhesive so that the bottom end remains closed after manufacture of the bag, and the upper end of the bag is closed and sealed with a suitable adhesive following filling of the bag with food to be cooked, and is openable following cooking of the food to enable access to the cooked food. If desired, the corner flaps formed between the gusseted side panels and the front and back panels may be secured by spots of adhesive positioned adjacent the diagonal fold lines defining the corner flaps to prevent the formation of pockets into which the popcorn may migrate during cooking of the popcorn. This structure is more fully described in applicant's prior U.S. Pat. No. 5,488,220.

In a specific construction according to the invention, an inner ply of greaseproof paper is laminated to an outer ply of gas permeable paper. The basis weights of the plies range from about 18# to about 25#, with the inner ply preferably comprising 21# greaseproof paper and the outer ply preferably comprising 25# B1 MF FC-807 kraft paper. A standard 48 gauge PET susceptor film is used as a microwave susceptor, and the plies are secured together by a standard National 33-9138 adhesive used at standard run viscosity. It should be understood, however, that papers having different basis weights, different microwave susceptors, and different adhesives may be used, as desired or necessary.

In accordance with the invention, the adhesive laminating the plies together covers only about 25% to 60% of the confronting area between the laminated plies, and preferably about 60%. The adhesive is applied in discrete patches or areas evenly spaced over the laminated area so that the plies are secured together to form a unitary structure. The top and bottom ends of the bag and the back seam are closed and sealed conventionally with continuous bands of adhesive. Further, a continuous layer of adhesive is applied between the microwave susceptor and the outer print ply to prevent delamination, and a continuous bond of adhesive is applied between the laminations at the opposite ends where the back seam is formed.

In the specific construction of a bag in accordance with the invention as described above, the spots or patches of adhesive comprise small circular areas uniformly distributed and spaced over the lamination. In a preferred construction, the patches of adhesive each has a diameter of about ¼ inch and are spaced apart approximately ½ inch center-to-center. The spaced patches of adhesive continue in the area between the microwave susceptor and the greaseproof inner ply, but a continuous layer of adhesive is provided between the susceptor and the outer ply. The patches of adhesive between the microwave susceptor and the inner ply may be larger than those securing the plies together, depending upon the particular requirements, and may have a diameter of from about 5/16 inch up to about ⅜ inch, for example. It should be understood, however, that different size and shape adhesive patches could be utilized in constructing the bag, depending upon the particular performance desired or required.

In addition to the reduction in cost and more pleasing shape obtained with the bag of the invention, it has been found that a bag constructed in accordance with the invention performs at least as well as conventional bags and in some instances perform better, i.e., achieves greater popped volume and results in fewer unpopped kernels than a conventional bag.

Other than the lamination of the inner and outer plies with spaced patches of adhesive as described above, the bag of the invention is constructed conventionally and functions normally during filling, cooking and dispensing of food cooked therein. Utilization of the spaced patches of adhesive according to the invention results in a bag having substantially lower cost than a conventional bag, and at the same time has improved performance as compared with a conventional bag.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Referring more specifically to the drawings, a bag in accordance with the invention is indicated generally at 10 in FIGS. 1–5. The bag includes a pair of generally rectangular front and back face panels 11 and 12, respectively, joined at opposite side edges by gusseted side panels 13 and 14.

Figure 1:
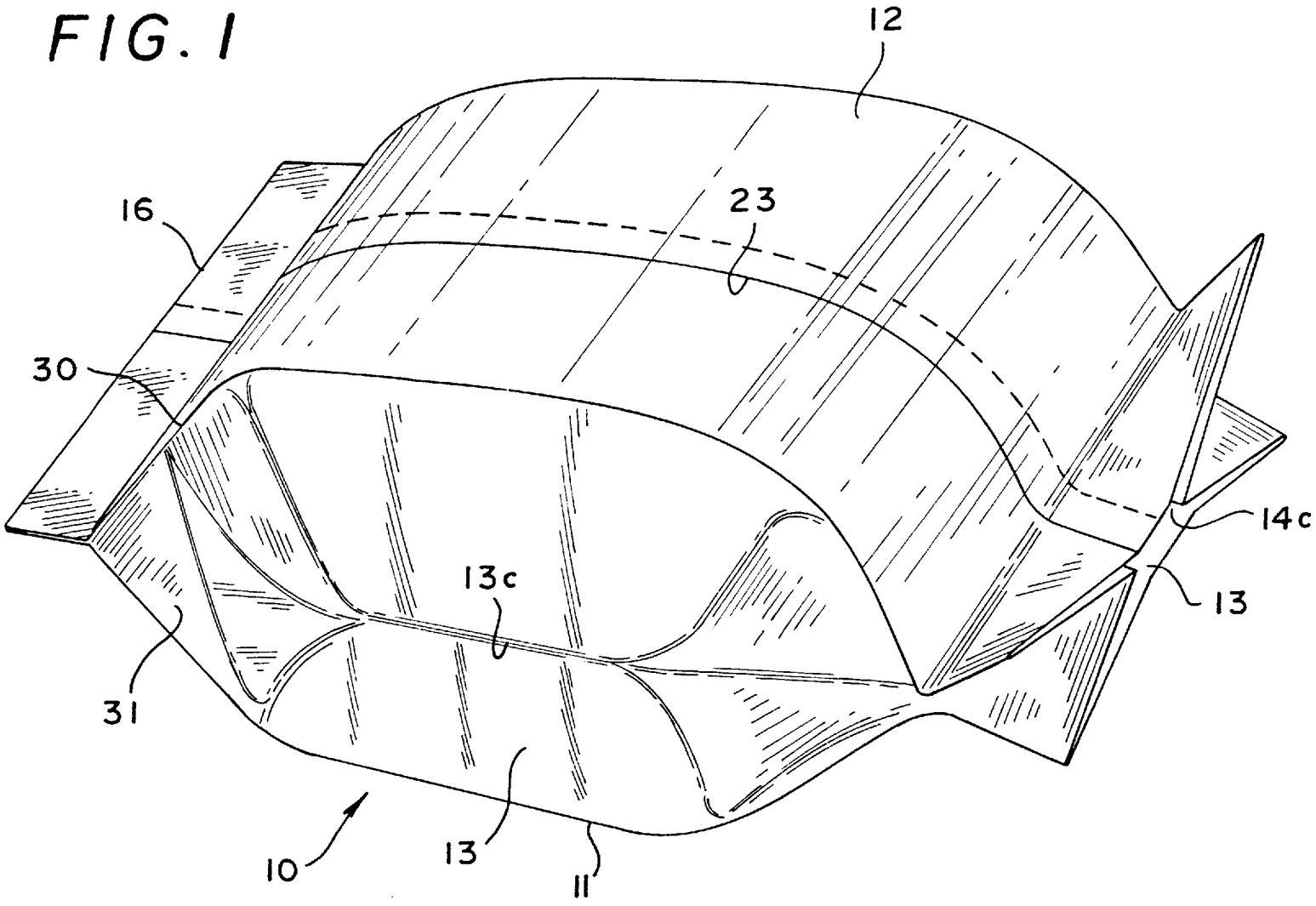
FIG. 1 is a top perspective view of a bag for microwave cooking of popcorn incorporating the features of the invention therein, showing the bag in an expanded condition.
Figure 2:
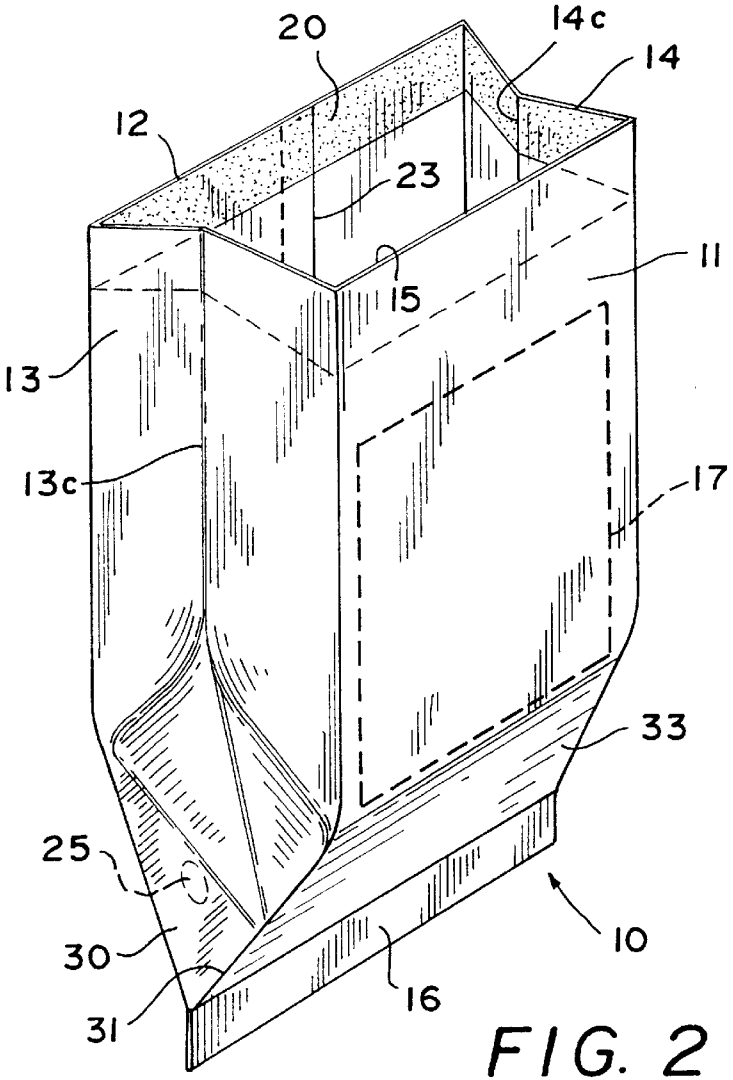
FIG. 2 is a top perspective view of the bag of FIG. 1, shown in an upright position with the upper end open for removing cooked food from the bag.
Figure 3:
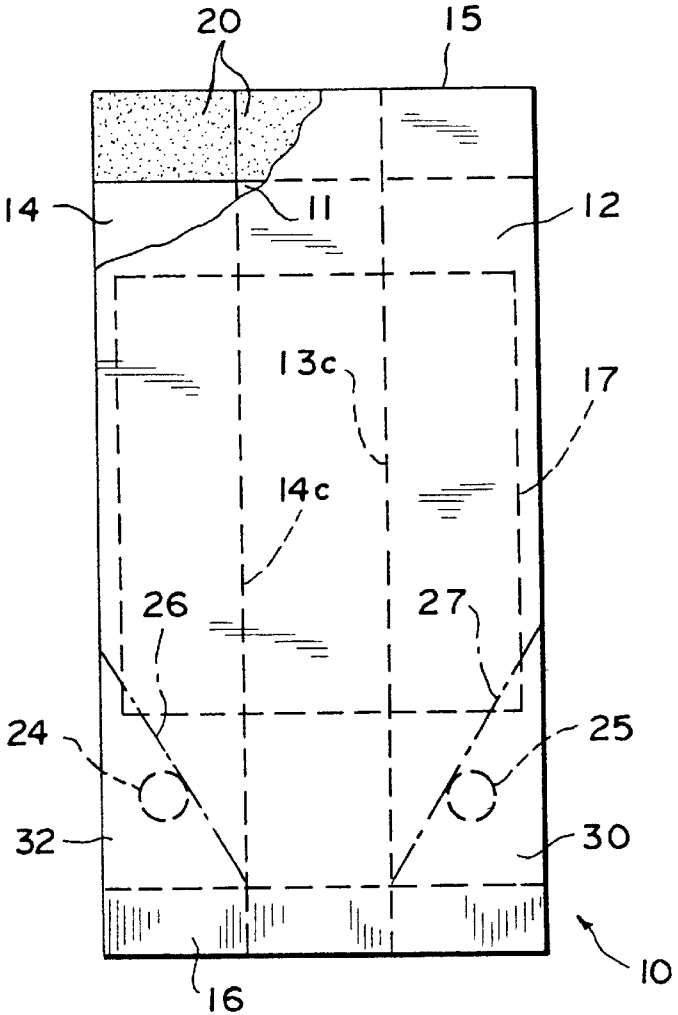
FIG. 3 is a plan view of the bag of FIGS. 1 and 2, shown in its flattened or unexpanded condition.
Figure 4:
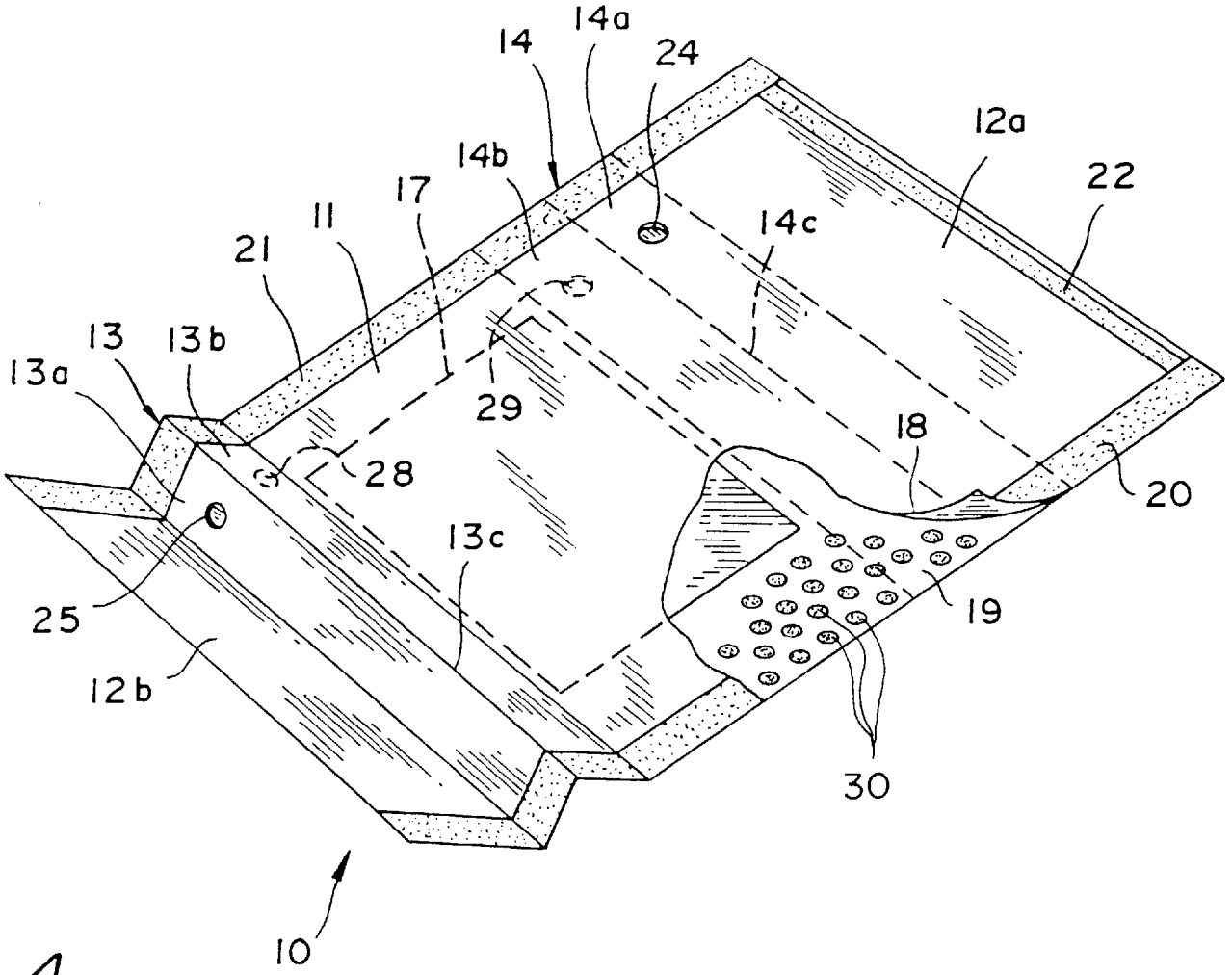
FIG. 4 is a top perspective view of the bag of the invention prior to being folded and assembled to make the bag of FIG. 1, with portions broken away to show the multiple layers or plies and the spaced adhesive used in its construction.
Figure 5:
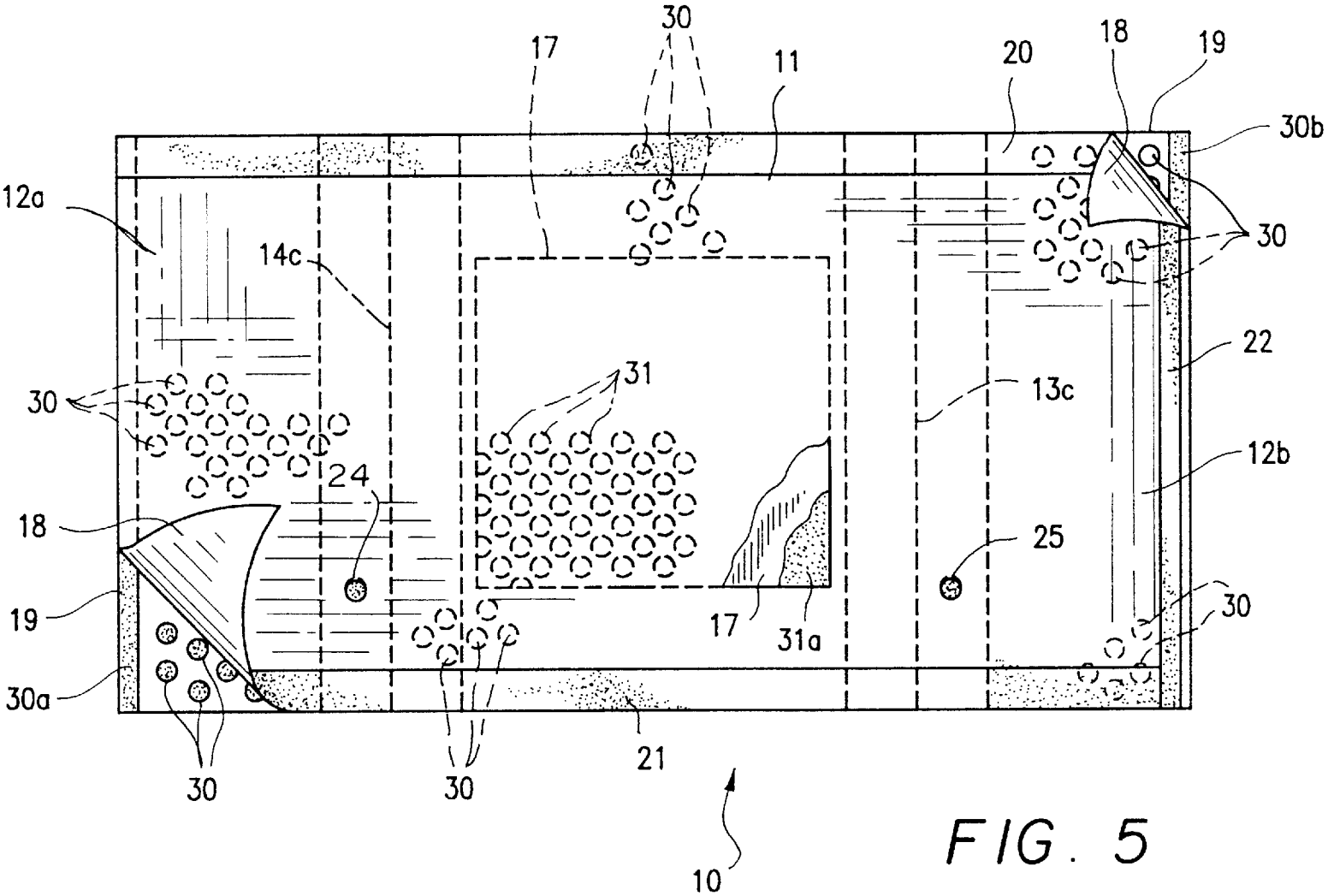
FIG. 5 is an enlarged top plan view of the bag of the invention prior to being folded and assembled to make the bag of FIG. 1, and showing in more detail the spaced patches of adhesive for securing the laminations together.

With particular reference to FIGS. 2, 4 and 5, the gusseted side panels 13 and 14 comprise first and second side panel portions 13*a*, 13*b* and 14*a*, 14*b*, respectively, joined along fold lines 13*c* and 14*c*, respectively, whereby the gusseted side panels may be folded inwardly with an accordion pleat so that the side panels lie between the front and back panels when the bag is in its fully folded, collapsed condition.

During manufacture of the bag, the front and back panels and gusseted side panels are pressed together at the bottom end 16 and adhesively secured to close and seal the bottom end of the bag.

When used for microwave cooking of food, the bag has a suitable heat enhancer or microwave susceptor 17 in face panel 11. In use, this side of the bag is placed downwardly or lower than the other sides so that the food contained in the bag rests on or closely adjacent the susceptor to facilitate heating and cooking of the food contained in the bag when the bag is placed in a microwave oven.

As seen best in FIGS. 4 and 5, the bag is of multiple ply construction and includes an inner grease-resistant layer or ply 18 and an outer layer or ply 19 of machine-finished paper for receiving high quality graphics. The microwave susceptor 17 is positioned between the plies 18 and 19 and extends over substantially the entire central portion of the front panel 11.

Strips of adhesive 20 and 21 are applied along the top and bottom edges of the multiple ply sheet used to form the bag to seal and hold the top and bottom ends of the bag closed when the panels are folded upon one another and pressed together. Similarly, a strip of adhesive 22 is applied along one end edge of one of the panel portions 12*a* or 12*b* of the back panel 12, and the free outer edges of these panel portions are brought into overlapping relationship during manufacture of the bag and pressed together to adhere the overlapping edges along the strip of adhesive 22, forming a back seam 23 to complete the construction of the bag.

The strips of adhesive 20, 21 and 22 may comprise any suitable commercially available thermoplastic material or thermoplastic, so long as the bottom seal and back seam remain intact and do not open during or after cooking of the food, but which enables the top seal to be opened by grasping the corner flaps formed by the gusseted side panels and the front and back panels, respectively, to open the bag in a conventional manner. Moreover, the adhesively secured top end of the bag should open slightly to form a vent during cooking of the food in the bag.

If desired, spots of adhesive 24 and 25 may be applied to the back panel portions 12*a* and 12*b* in positions determined to lie immediately adjacent the diagonal folds 26 and 27 that will form between the expanding portions of the gusseted side panels and the secured end portions thereof when the bag expands during cooking of the food therein. The spots of adhesive are located between the back panel and the corner flap panels at the closed bottom end of the bag so as not to interfere with filling of the bag or opening of it after the food has been cooked. Further, the spots of adhesive are in the back panel, opposite to the front panel containing the susceptor.

Thus, when back panel portions 12*a* and 12*b* are folded inwardly over side panel portions 13*a* and 14*a*, the spots of adhesive 24 and 25 will secure the panel portions together, preventing the formation of pockets between these panel portions when the bag is expanded as shown in FIGS. 1, 2, 4 and 5.

Two additional spots of adhesive 28 and 29 may be provided on the front panel 11 for cooperation with gusseted side panel portions 13*b* and 14*b* to additionally secure the side panel portions to the front panel, but this is not necessary since adhesion of the back panel to the side panel portions will tend to close any pockets that might otherwise form between the front panel and the gusseted side panel portions. However, provision of the additional spots of adhesive 28 and 29 will ensure against the migration of any food particles into any space that might tend to develop between the front panel and the gusseted side panel portions in the area of corner flaps 30 and 31 or 32 and 33 (see FIGS. 2 and 4).

It should be noted that suitable indexing means (not shown) may be provided on the bag so that the position of the mitre spots 24 and 25 may be automatically adjusted by repositioning the adhesive applying means (not shown) during manufacture of the bag to compensate for minor variations in bag dimensions or placement of the fold lines 26 and 27. Additionally, or in lieu thereof, the mitre spots of adhesive 24 and 25 preferably comprise a flowable adhesive material that enables the adhesive to spread out and accommodate itself to the pressure applied during manufacture of the bag, thereby adjusting itself to slight variations in positioning of the fold lines 26 and 27. Additionally, the mitre spots of adhesive 24, 25 (and 28, 29, if used) may be applied on both of the respective panels which are to be adhesively secured together, whereby an adhesive-to-adhesive contact is effected.

All of the structure thus far described is substantially as described in applicant's prior U.S. Pat. No. 5,488,220. As normally practiced, the bag is made in stages, i.e., suitable graphics are first printed on the outer layer or ply, which is then laminated to the inner layer with the microwave susceptor sandwiched therebetween, and with adhesive strips 20 and 21 applied and dried. The roll stock thus produced is then put on a bag machine and liquid adhesive is applied to form the strip 22, after which the panels are folded over one another and pressed together to make the gussets and the back seam 23.

According to the present invention, the inner and outer plies 18 and 19 are secured together to form the laminated multi-wall bag construction by use of a plurality of spaced apart patches of adhesive 30 uniformly distributed throughout the area between the plies, except at opposite ends of the plies in the area which forms the back seam. Continuous bands of adhesive 30*a* and 30*b* are applied between the plies in this area. See FIG. 5.

As shown in FIG. 5, the microwave susceptor 17 is secured to the inner ply 18 by a plurality of spaced patches of adhesive 31, and is secured to the outer ply by a continuous layer of adhesive 31*a* in accordance with conventional practice.

In a preferred construction, the patches of adhesive 30 and 31 comprise circular spots or dots each having a ¼ inch diameter and spaced apart ½ inch center-to-center. However, depending upon requirements the patches of adhesive 31 attaching the susceptor 17 to the inner ply may be larger than the patches 30, and could have, for example, a diameter ranging from about 5/16 inch up to about ⅜ inch, and could be spaced apart ½ inch or more, e.g., 9/16 inch, center-to-center.

It should be understood that the size and shape of the patches of adhesive, and the spacing between them, can be varied from the specific dimensions given, but if the patches are too small or are spaced too far apart, there is not enough adhesion between the plies forming the laminated multi-wall bag structure, and delamination can occur. Moreover, inadequate use of adhesive can result in a bag that does not have adequate strength to perform satisfactorily when used for microwave cooking. It has been found that an adhesive coverage of from about 25% up to about 60% results in a satisfactory bag construction, although at coverages less than about 30%, the bag performance decreases. Moreover, at the lower range of adhesive coverage, the bag can not be run on conventional laminating machinery, at least partially because the plies forming the lamination have a tendency to shift relative to one another. Thus, dots of adhesive that are too small or are spaced too far apart do not provide enough bonding between the plies, with the result that delamination may occur. Larger spots or spots placed closer together, use too much adhesive and result in a stiff wall structure with cost and performance similar to that of a conventional bag.

The utilization of spaced patches of adhesive as described results in the use of much less adhesive than is required in conventional bag constructions, and produces a bag having a more flexible side wall, whereby the bag assumes a more square shape when the food is cooked therein and the bag expands. The greater flexibility of the bag wall can also result in greater popped volume and fewer unpopped kernels than with conventional bags. Additionally, there is less chance of blistering or delamination between the susceptor and the inner ply because moisture is allowed to escape.

The bags of the invention may be constructed with any suitable materials, although in a preferred construction, the inner ply comprises a 21# greaseproof paper, and the outer ply comprises a 25# B1 MF FC-807 kraft paper. The outer ply is gas permeable so that gas is enabled to escape from between the plies through the outer ply, thereby preventing expansion between the plies. Any moisture between the plies is also free to escape through the unsecured areas between the patches of adhesive at the ends of the bag.

The utilization of spaced patches or spots of adhesive rather than a continuous layer of adhesive to secure the plies together in forming the laminated multi-wall bag construction of the invention thus minimizes the use of material and reduces the cost of manufacturing the bag, while at the same time producing a bag whose performance is at least equivalent or superior to that of conventional bag constructions.

Following manufacture of the bag, and prior to filling it with the food to be cooked, the bag is shipped in its flattened or collapsed condition to a suitable facility for filling the bag with food to be cooked. Prior to placing the food in the bag, approximately one-third of the length of the bag at the closed bottom end is folded into overlying relationship with the central body portion of the bag. Following filling of the bag, the top end is closed and sealed and then folded over to retain the food in the central portion of the bag adjacent the heat enhancer. Reference may be made to FIGS. 6, 7 and 10 in U.S. Pat. No. 5,326,576, to Zuege, which illustrates typical steps during the manufacturing process.

As the food contained in the bag cooks and expands, the gusseted side panels fold outwardly and the front and back panels move away from one another to enlarge the interior of the bag. Simultaneously, and as described more fully hereinafter, the closed top end of the bag partially opens to define a vent to enable escape of gases, steam and the like from the interior of the bag during cooking of the food therein.

While particular embodiments of the invention have been illustrated and described in detail herein, it should be understood that various changes and modifications may be made to the invention without departing from the spirit and intent of the invention as defined by the scope of the appended claims.

What is claimed is:

1. A bag having a multi-ply laminated wall structure, comprising:

at least two plies of paper secured together with spaced patches of adhesive distributed over the area between the plies, said spaced patches of adhesive covering from about 25% up to about 60% of the confronting area between the plies to form a unitary, multi-ply, laminated wall structure having unsecured areas between the plies, said unsecured areas being in communication with one another and including unsecured areas between the plies through at least one end of the wall structure, whereby any moisture between the plies can escape through the unsecured areas between the plies at said at least one end of the laminated wall structure; and an outer of said plies is gas permeable so that gas can escape therethrough from between the plies to prevent separation of the plies and expansion of the unsecured areas.

2. A bag as claimed in claim 1, wherein:

said spaced patches of adhesive comprise substantially circular spots of adhesive, said spots of adhesive each having a diameter of about one-quarter inch and being spaced apart about one-half inch, center-to-center.

3. A bag as claimed in claim 2, wherein:

said bag includes a front panel and a back panel;

a microwave susceptor is secured between the plies in the front panel by spaced patches of adhesive between the susceptor and the inner ply and a continuous layer of adhesive between the susceptor and the outer ply; and the spaced patches of adhesive securing the susceptor to the inner ply each has a diameter of from about five-sixteenths inch up to about three-eighths inch, and the patches of adhesive are spaced apart approximately one-half to nine-sixteenths inch, center-to-center.

4. A bag as claimed in claim 1, wherein:

said bag has a front panel, a back panel and gusseted side panels joining the front and back panels; and a microwave susceptor is in said front panel.

5. A bag as claimed in claim 4, wherein:

said plies of paper comprise an inner greaseproof ply and an outer ply of kraft paper; and said susceptor is secured to the inner ply with spaced patches of adhesive and to the outer ply with a continuous layer of adhesive.

6. A bag as claimed in claim 5, wherein:

the patches of adhesive securing the susceptor to the inner ply are larger than the patches of adhesive securing the inner and outer plies together.

7. A bag as claimed in claim 4, wherein:

said laminated wall structure comprises an inner greaseproof ply of 21# paper, and an outer ply of 25# kraft paper.

8. A bag having a multi-ply laminated wall structure, comprising:

at least two plies of paper secured together with spaced patches of adhesive distributed over the area between the plies to form a unitary, multi-ply laminated wall structure having unsecured areas, including unsecured areas through at least one end of the laminated structure, the unsecured areas between the plies being in communication with one another and in communication with the atmosphere through said at least one end, whereby any moisture between the plies can escape through the unsecured areas between the plies at said at least one end of the laminated wall structure, preventing separation and expansion of the plies in the unsecured areas, said patches of adhesive securing adequate confronting areas between the plies to prevent shifting of the plies relative to one another.

9. A bag as claimed in claim 8, wherein:

the spaced patches of adhesive cover from about 25% up to about 60% of the confronting area between the plies.

10. A bag as claimed in claim 8, wherein:

the plies of said wall structure include an inner ply and an outer ply, said outer ply being gas permeable so that gas can escape therethrough from between the plies.

11. A bag as claimed in claim 8, wherein:

the unsecured areas include unsecured areas between the plies through both ends of the laminated wall structure, whereby any moisture between the plies can escape through the unsecured areas between the plies at both ends of the wall.

12. A bag as claimed in claim 8, wherein:

said spaced patches of adhesive comprise substantially circular spots of adhesive, said spots of adhesive each having a diameter of about one-quarter inch and being spaced apart about one-half inch, center-to-center.

13. A bag as claimed in claim 12, wherein:

said bag includes a front panel and a back panel;

a microwave susceptor is secured between the plies in the front panel by spaced patches of adhesive between the susceptor and the inner ply and a continuous layer of adhesive between the susceptor and the outer ply; and the spaced patches of adhesive securing the susceptor to the inner ply each has a diameter of from about five-sixteenths inch up to about three-eighths inch, and the patches of adhesive are spaced apart approximately one-half to nine-sixteenths inch, center-to-center.

14. A bag having a multi-ply laminated wall structure, comprising:

at least two plies of paper secured together with spaced patches of adhesive distributed over the area between the plies to attach the plies to one another so that they are fixed to one another to form a unitary, multi-ply laminated wall structure having unsecured areas, said unsecured areas being in communication with one another;

said laminated wall structure including a bag front panel and a bag back panel; and a microwave susceptor in said front panel, secured to an inner ply of said wall structure with spaced patches of adhesive and to an outer ply with a continuous layer of adhesive.

15. A bag as claimed in claim 14, wherein:

the spaced patches of adhesive cover from about 25% up to about 60% of the confronting area between the plies.

16. A bag as claimed in claim 15, wherein:

the plies of said wall structure include an inner ply and an outer ply, said outer ply being gas permeable so that gas can escape therethrough from between the plies.

17. A bag as claimed in claim 16, wherein:

the unsecured areas include unsecured areas between the plies through at least one end of the laminated wall structure, said unsecured areas through said at least one end being in communication with the unsecured areas between the plies forming the wall structure, whereby any moisture between the plies can escape through the unsecured areas between the plies at said at least one end.

18. A bag as claimed in claim 14, wherein:

said spaced patches of adhesive comprise substantially circular spots of adhesive, said spots of adhesive each having a diameter of about one-quarter inch and being spaced apart about one-half inch, center-to-center.

19. A bag as claimed in claim 18, wherein:

said bag includes a front panel and a back panel;

a microwave susceptor is secured between the plies in the front panel by spaced patches of adhesive between the susceptor and the inner ply and a continuous layer of adhesive between the susceptor and the outer ply; and the spaced patches of adhesive securing the susceptor to the inner ply each has a diameter of from about five-sixteenths inch up to about three-eighths inch, and the patches of adhesive are spaced apart approximately one-half to nine-sixteenths inch, center-to-center.

20. A bag for popping popcorn in a microwave oven, comprising:

a pair of substantially rectangularly shaped front and back face panels having top and bottom ends and opposite side edges;

a pair of opposite side panels coterminous in length with the face panels and joining the opposite side edges of the front and back face panels, said side panels each having a longitudinal accordion pleat therein defining longitudinally extending gusset folds in the side panels;

bag end closure means for securing the ends of the front and back face panels and the gusseted side panels together to close and seal the ends of the bag;

said gusseted side panels being expandable about the folds therein during cooking of food in the bag to enlarge the interior volume of the bag, and when unfolded to the expanded position, forming triangularly shaped corner flaps at the junctures of the gusseted side panels and the top and bottom ends of the front and back face panels, respectively, said corner flaps each having a folded edge extending diagonally inwardly from the juncture of the respective side panel and the adjoining face panel toward an adjacent end of the bag, and having confronting, contiguous, triangularly shaped surface portions between the respective side panel and the adjoining front and back face panels;

attachment means joining the confronting surface portions between the side panels and at least one of the front and back face panels at least at one end of the bag immediately adjacent the diagonal folded edge and spaced from the adjacent bag end closure means to hold the confronting surface portions in contiguous relationship, thereby preventing the formation of pockets or spaces between the confronting surface portions in which food might otherwise collect; and said front and back face panels and gusseted side panels comprising a multi-wall structure formed of inner and outer plies laminated together to form a unitary laminated wall structure, said plies being secured together with spaced patches of adhesive distributed over the area between the plies so that the unsecured areas between the patches of adhesive are in communication with one another throughout the laminated area between the plies.

21. A bag for popping popcorn in a microwave oven, as claimed in claim 20, wherein:

a microwave susceptor is in the front panel.

22. A bag as claimed in claim 21, wherein:

said susceptor is secured to the inner ply with spaced patches of adhesive and to the outer ply with a continuous layer of adhesive.

23. A bag for popping popcorn in a microwave oven, as claimed in claim 20, wherein:

the patches of adhesive cover from about 25% up to about 60% of the area between the plies.

24. A bag for popping popcorn in a microwave oven, as claimed in claim 20, wherein:

the outer ply is gas permeable so that gas can escape therethrough from between the plies to prevent separation and expansion of the plies in the unsecured areas.

25. A bag for popping popcorn in a microwave oven, as claimed in claim 24, wherein:

the spaced patches of adhesive leave unsecured areas between the plies extending through at least one end of the wall structure, in communication with the space in the remaining unsecured areas between the plies forming the wall of the bag, whereby gas and any moisture between the plies can escape through the unsecured areas in said at least one end of the wall.

26. A bag for popping popcorn in a microwave oven, as claimed in claim 25, wherein:

unsecured areas extend through both ends of the wall, in communication with the space in the remaining unsecured areas between the plies forming the wall of the bag, whereby gas and any moisture between the plies can escape through the unsecured areas in both ends of the wall structure.

* * * * *